US009879956B2

(12) United States Patent
Derus et al.

(10) Patent No.: US 9,879,956 B2
(45) Date of Patent: Jan. 30, 2018

(54) ARROWHEAD ADAPTER AND ASSEMBLY OPERABLE WITH MULTIPLE TYPES OF ARROW SHAFTS

(71) Applicant: Slick Trick LLC, West Henrietta, NY (US)

(72) Inventors: Michael W. Derus, Victor, NY (US); Hans Walthert, Leroy, NY (US)

(73) Assignee: Slick Trick LLC, West Henrietta, NY (US)

( * ) Notice: Subject to any disclaimer, the term of this patent is extended or adjusted under 35 U.S.C. 154(b) by 0 days.

(21) Appl. No.: 15/352,113

(22) Filed: Nov. 15, 2016

(65) Prior Publication Data

US 2017/0138707 A1 May 18, 2017

Related U.S. Application Data

(60) Provisional application No. 62/255,718, filed on Nov. 16, 2015.

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS

| | | | | |
|---|---|---|---|---|
| 6,540,628 | B1 | 4/2003 | Musacchia, Jr. | |
| 6,758,774 | B2 | 7/2004 | Leichty, II | |
| 6,793,596 | B1 | 9/2004 | Sullivan et al. | |
| 6,830,523 | B1 | 12/2004 | Kuhn | |
| 6,863,630 | B1 | 3/2005 | Watkins et al. | |
| 7,314,419 | B2 | 1/2008 | Grace et al. | |
| 7,972,230 | B2 | 7/2011 | Donahoe | |
| 8,016,703 | B1 * | 9/2011 | Kronengold | F42B 6/08 473/582 |
| 8,337,342 | B1 * | 12/2012 | Huang | F42B 6/04 473/582 |
| 8,480,520 | B2 * | 7/2013 | Webber | F42B 6/08 473/582 |
| 8,961,341 | B2 * | 2/2015 | Dickerson | F42B 6/08 473/582 |
| 2006/0276276 | A1 | 12/2006 | Polando | |
| 2007/0123378 | A1 | 5/2007 | Polando | |
| 2009/0163308 | A1 * | 6/2009 | Odabachian | F42B 6/08 473/582 |

FOREIGN PATENT DOCUMENTS

WO 2008079658 A2 7/2008

OTHER PUBLICATIONS

Pope and Young Club/St. Charles Museum; Jul. 9, 2014; retrieved from the Internet: <https://www.youtube.com/watch?v=tlcw9Q5Y_rM>: 4 pages.

Traditional /Vintage Broadheads; ACE Manufacturing; on or before Dec. 31, 1941; 46 pages.

* cited by examiner

*Primary Examiner* — John Ricci
(74) *Attorney, Agent, or Firm* — Barclay Damon LLP

(57) ABSTRACT

An arrowhead adapter, in an embodiment, includes an interface and a body which defines a bore. The body has an outer surface configured to fit within a gap formed between an inner surface of an arrow shaft and a blade holder to apply a stabilizing force to the blade holder in the assembled state.

22 Claims, 11 Drawing Sheets

ARROWHEAD ADAPTER AND ASSEMBLY OPERABLE WITH MULTIPLE TYPES OF ARROW SHAFTS

CROSS-REFERENCE TO RELATED APPLICATION

This application is a non-provisional of, and claims the benefit and priority of, U.S. Provisional Patent Application No. 62/255,718, filed on Nov. 16, 2015. The entire contents of such application are hereby incorporated by reference.

BACKGROUND

Bow hunting has become a very popular sport in North America and around the world. The typical arrowhead includes a blade set and a ferrule or blade holder that holds the blade set. The ferrule screws into the arrow shaft. Archers use arrow shafts of different diameters for various reasons and preferences. For example, an archer may use a standard diameter shaft for certain targets and conditions, and a micro-diameter shaft for other targets and conditions. Conventionally, ferrules of different diameters are used for the differently-sized arrow shafts.

Each arrowhead, including the blade set and the ferrule, has an industry standard weight that is optimal for the selected arrow shaft. Matching the arrow shaft with an arrowhead of proper weight is necessary for optimal performance and accuracy. For example, using a relatively heavy arrowhead on a relatively small, lightweight arrow shaft could cause poor or sub-optimal flight performance of the arrow. To accommodate for the weight differences between the different ferrules, while achieving the desired standard weights, manufacturers must offer one style of blade set for standard arrow shafts and a different style of blade set for micro arrow shafts. This requires archers to buy different styles of blade sets for the different arrow shafts which can create a burdensome cost for archers. Moreover, having to supply different styles of blade sets causes an increase in supply chain, manufacturing and inventory costs for manufacturers.

The foregoing background describes some, but not necessarily all, of the problems, disadvantages and shortcomings related to the use of arrowheads with arrow shafts of different sizes.

SUMMARY

In an embodiment, the disclosed subject matter includes an arrowhead adapter. The arrowhead adapter includes a flange portion having a forward end or face and a rearward end or face. The forward face is configured to engage a portion of a blade and a blade holder. The rearward face is configured to engage an impact end of an arrow shaft. A body portion projects from the flange portion and has an outer surface configured to fit within a gap formed between an inner surface of the arrow shaft and the blade holder. A central bore extends through the flange portion and the body portion being defined by a tubular wall that is configured to receive a portion of the blade holder.

In an embodiment, the arrowhead adapter includes an interface. The interface has a blade engager that is configured to engage at least one blade held by a blade holder. The blade holder has a neck. The neck has a primary neck portion with a neck diameter, and the neck further has a threaded neck portion with a plurality of neck threads. Depending upon the embodiment, the primary neck portion can have a non-threaded, exterior surface.

The interface of the adapter also has an arrow shaft engager configured to engage the terminating surface of the arrow shaft at its impact end. The arrow shaft includes a non-threaded shaft portion with an inner shaft diameter and a threaded shaft portion having a plurality of shaft threads. Depending upon the embodiment, the non-threaded and threaded shaft portions can be components of a shaft insert or shaft member that is coupled to or inserted into the arrow shaft. The arrowhead adapter also includes a body that extends from the arrow shaft engager. The body has an inner tubular wall that is configured to receive the primary neck portion of the blade engager. The interface and the body define a bore or passageway such that the neck may be inserted into the bore and the threaded neck portion may be screwed into the shaft member or arrow shaft.

When the neck is inserted into the bore and the threaded neck portion is screwed into the arrow shaft: (a) the neck diameter is such that there is a gap between the primary neck portion of the blade engager and the primary shaft portion; (b) the outer tubular wall is configured to fit within the gap and apply a stabilizing force to the blade holder; (c) the one or more blades and the blade holder have an initial weight that is less than an optimal weight or designated weight or weight threshold; and (d) the interface and the body of the adapter have a supplemental weight. The sum of the initial weight and the supplemental weight is at least as great as the optimal or designated weight. In an embodiment, sum of the initial weight and the supplemental weight is equal to, or substantially equal to, the optimal weight or designated weight or weight threshold.

In another embodiment, the arrowhead assembly comprises an arrowhead adapter comprising. The arrowhead adapter includes a blade engager configured to contact at least one blade, a shaft member engager configured to engage an arrow shaft member, and a body member defining a channel. The arrowhead adapter further includes a blade holder having a neck and being configured to retain the at least one blade. The neck comprises a primary neck portion having an exterior surface with a neck diameter and which is configured to be inserted into the channel of the body member.

The neck further includes a threaded neck portion comprising a plurality of exterior neck threads and which is configured to be inserted into a cavity defined by an inner surface of the arrow shaft member. The cavity comprises a larger diameter than the neck diameter such that when the threaded neck portion is inserted through the channel, positioned in the cavity and threadably engaged with the arrow shaft member, the body member of the arrowhead adapter is configured to fit between an exterior surface of the primary neck portion and the inner surface of the arrow shaft member.

Additional features and advantages of the present disclosure are described in, and will be apparent from, the following Brief Description of the Drawings and Detailed Description.

DETAILED DESCRIPTION

Figure 1:
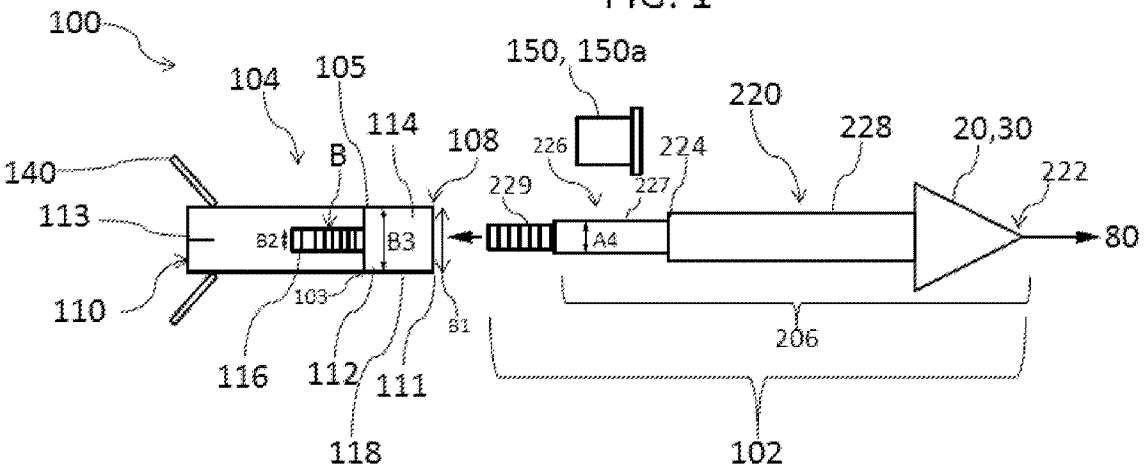
FIG. 1 is a schematic diagram illustrating an embodiment of an arrowhead assembly for a standard arrow shaft, illustrating the arrowhead assembly separated from the standard arrow shaft.
Figure 2:
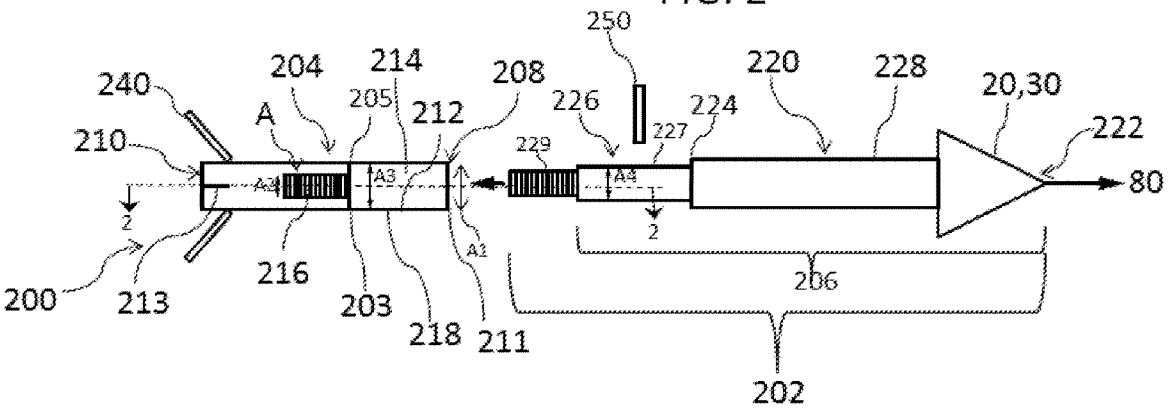
FIG. 2 is a schematic diagram illustrating an embodiment of an arrowhead assembly for a micro arrow shaft, illustrating the arrowhead assembly separated from the micro arrow shaft.

Referring to FIGS. 1 and 2, in an embodiment, the present disclosure describes an arrowhead adapter 150 for a standard arrow 100. Standard arrow 100 includes a standard arrowhead assembly 102 attachable to a standard arrow shaft 104. Standard arrowhead assembly 102 includes micro common elements 206 shared in common with a micro arrowhead assembly 202 attachable to a micro arrow shaft 204 of a micro arrow 200. The arrowhead adapter 150 enables the micro common elements 206 to be interchangeably used in conjunction with arrow shafts 104, 204 of different diameters. In an embodiment, the arrowhead adapter 150 enables a common blade 20, 30 and a micro common neck diameter A4 to be used with arrow shafts 104, 204 of different diameters while achieving the optimal or designated arrowhead assembly threshold weight associated with the applicable arrowhead type.

In an embodiment, there is a schedule or list of different arrowhead assembly weight thresholds in accordance with applicable archery industry standards, manufacturer specifications or user preferences. Each such weight threshold is the sum of the weights of the ferrule or blade holder 220 the arrowhead itself (such as blades 20, 30) and any other components attached to the blade holder 220. The particular type, style, size and shape of the arrowhead affects this arrowhead assembly weight threshold. This weight threshold may vary within a range of weights such as 85 grains, 100 grains, 125 grains or 150 grains depending upon which arrowhead the archer selects for the application and intended target.

The same blade type is used in the example of the embodiments illustrated in FIGS. 1-4. In this example, blade sets 20, 30 of arrowhead assemblies 102 and 202 are identical. Accordingly, there is a designated threshold weight of X grains for micro arrowhead assembly 202 (FIG. 2), and there is the same designated threshold weight of X grains for standard arrowhead assembly 102 (FIG. 1). Achieving this threshold weight is important for archery accuracy and performance.

In an example, micro neck diameter A4 is relatively small in size. As such, micro neck diameter A4 is structurally suitable for micro arrow shaft 204. However, micro neck diameter A4 would not be structurally suitable for standard arrow shaft 104 without the inclusion of arrowhead adapter 150 in a standard arrow 100. Also, the relatively small diameter of A4 results in an arrowhead assembly weight that meets the weight threshold of X grains for micro arrowhead assembly 202. As described below, the arrowhead adapter 150 provides weight compensation or adjustment for the standard arrowhead assembly 102 by adding additional weight to achieve the optimal weight threshold for a standard arrowhead assembly 102 which is necessary for optimal performance. In one example, the weight threshold for the standard arrowhead assembly 102 is X grains, the same as the weight for the micro arrowhead assembly 202. In another example, the weight threshold of the standard arrowhead assembly 102 is Y grains, a magnitude greater than X grains. In the latter example, the arrowhead adapter 150 can provide the necessary weight increase to reach Y grains.

Figure 6:
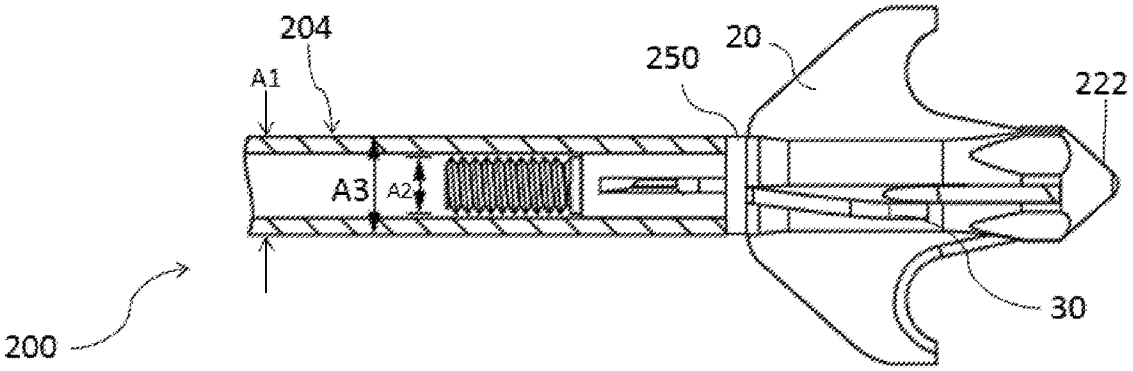
FIG. 6 is a partial cross-sectional view of the arrowhead assembly of FIG. 2 inserted into the micro arrow shaft of FIG. 2, taken substantially along line 2-2 of FIG. 2.

In an embodiment illustrated in FIGS. 2 and 6, micro arrow shaft 204 of micro arrow 200 extends between the front end or impact end 208 and the tail end 210. The micro arrow shaft 204 has a tubular, exterior surface 205. The exterior surface 205 has an exterior diameter A1. The tail end 210 includes a nock 213 which is configured to receive a bowstring, and the tail end 210 has a plurality of stabilizers, fletchings, vanes or fins 240. The impact end 208 has a terminating surface 211. The impact end 208 is hollowed having an interior surface 212 that defines an inner cavity 214. The interior surface 212 has a threaded shaft section 216 and a non-threaded shaft section 218. In an embodiment, the threaded shaft section 216 extends from the non-threaded shaft section 218 in a rearward direction towards the tail end 210. As illustrated in the embodiment shown in FIG. 1, the non-threaded shaft section 218, in an embodiment, has an interior diameter A3 that is greater than the interior diameter A2 of the threaded shaft section 216. The threaded shaft section 216, in an embodiment, has a Unified National Fine (UNF) thread profile A. In an embodiment, thread profile A is UNF 6-40. As shown, the micro arrow shaft 204 is tubular; however other embodiments of arrow shaft 204 may not be tubular.

In an embodiment, the micro arrow shaft 204 is configured to be coupled to or receive a shaft attachment, shaft insert or shaft member 203. In such embodiment, the shaft member 203 incorporates the interior surface 212, threaded shaft section 216 and non-threaded shaft section 218. Depending upon the embodiment, the shaft member 203 can be screwed onto, inserted into, or connected to the micro arrow shaft 204 in any suitable fashion.

In the embodiments illustrated in FIGS. 1 and 3-5, standard arrow shaft 104 of standard arrow 100 extends between the impact end 108 and the tail end 110. The standard arrow shaft 104 has a tubular, exterior surface 105. The exterior surface 105 has an exterior diameter B1. The tail end 110 includes a nock 213 which is configured to receive a bowstring, and the tail end 110 has a plurality of stabilizers, fletchings, vanes or fins 140. The impact end 108 has a terminating surface 111. The impact end 108 is hollowed having an interior surface 118 that defines an inner cavity 114. The interior surface 118 has a threaded shaft section 116 and a non-threaded shaft section 112. In an embodiment, the threaded shaft section 116 extends from the non-threaded shaft section 112 in a rearward direction towards the tail end 110. As illustrated in the embodiment shown in FIG. 1, the non-threaded shaft section 112 has an interior diameter B3 that is greater than the interior diameter B2 of the threaded shaft section 116. The threaded shaft section 116, in an embodiment, has a Unified National Fine (UNF) thread profile B. In an embodiment, the thread profile B is UNC 8-32. As shown, the micro arrow shaft 104 is tubular; however other embodiments of arrow shaft 104 may not be tubular.

The standard arrow shaft 104 is configured to be coupled to or receive a shaft attachment, shaft insert or shaft member 103. In such embodiment, the shaft member 103 incorporates the interior surface 118, threaded shaft section 116 and non-threaded shaft section 112. Depending upon the embodiment, the shaft member 103 can be screwed onto, inserted into, or connected to the micro arrow shaft 104 in any suitable fashion.

In the embodiment shown, the standard arrow shaft 104 has the same structure, elements and functionality of micro arrow shaft 204 except that standard arrow shaft 104 has a larger diameter than the diameter of the micro arrow shaft 204. In particular, exterior surface 105 has exterior diameter B1 (FIG. 1) that is greater than the exterior diameter A1 (FIG. 2) of micro arrow shaft 204. Referring to FIG. 1, the interior diameter B3 of the non-threaded shaft section 112 is greater than interior diameter A3 of micro arrow shaft 204. The interior diameter B2 of the threaded shaft section 116 is greater than the interior diameter A2 of micro arrow shaft 204. The threaded shaft section 116, in an embodiment, has a Unified National Course (UNC) thread profile B compatible with any diameter greater than A2 (FIG. 2). In an embodiment, thread profile B is UNC 8-32.

Referring to FIGS. 1-2, the micro common elements 206 of each arrow 100, 200 include: (a) a ferrule or blade holder 220 with a micro head 228, a shoulder 224 and a neck 226; and (b) a blade or blade set 20, 30 held by the blade holder 220. In an embodiment illustrated in FIGS. 5-8, the micro head 228 has a pointed tip 222. The neck 226 includes a micro shank portion or micro primary neck portion 227. In the embodiment shown, the micro primary neck portion 227 is non-threaded.

As illustrated in FIG. 2, the neck 226 of the micro arrowhead assembly 202 has a threaded neck portion 229. As described above, the micro primary neck portion 227 has a micro diameter A4. The threaded neck portion 229 has thread profile A for compatibility with thread profile A of micro arrow shaft 204. As illustrated in FIG. 1, the neck 226 of the standard arrow 100 also has a threaded neck portion 229. However, the threaded neck portion 229 of standard arrow 100 has thread profile B for compatibility with thread profile B of standard arrow shaft 104.

Figure 7:
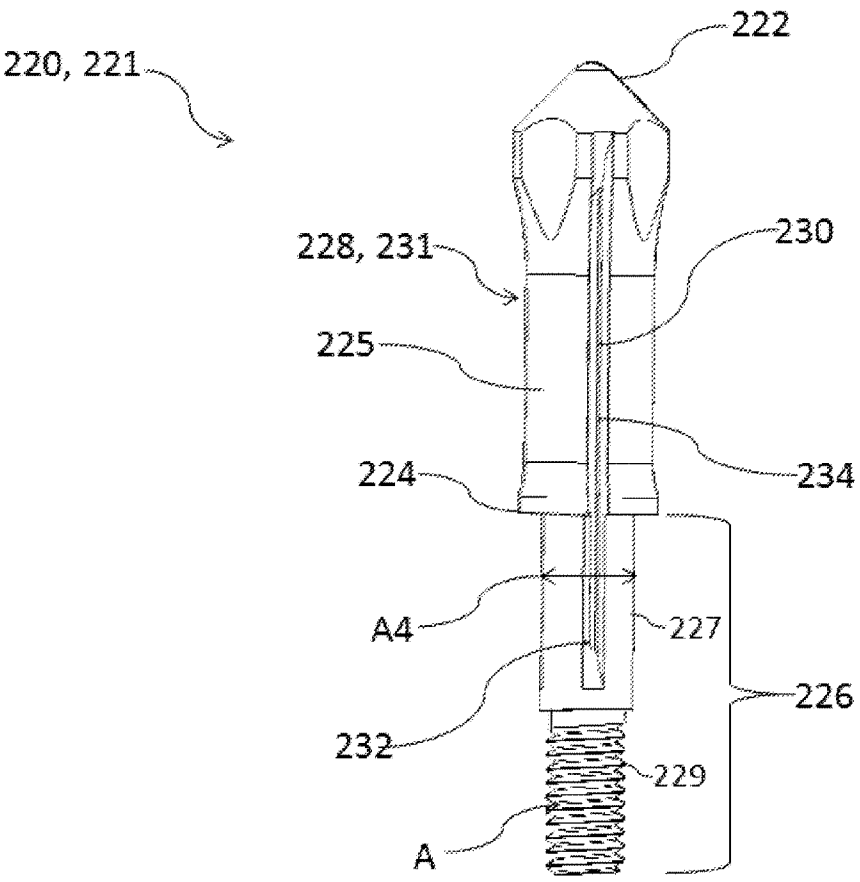
FIG. 7 is an isometric view of an embodiment of a micro blade holder.
Figure 8:
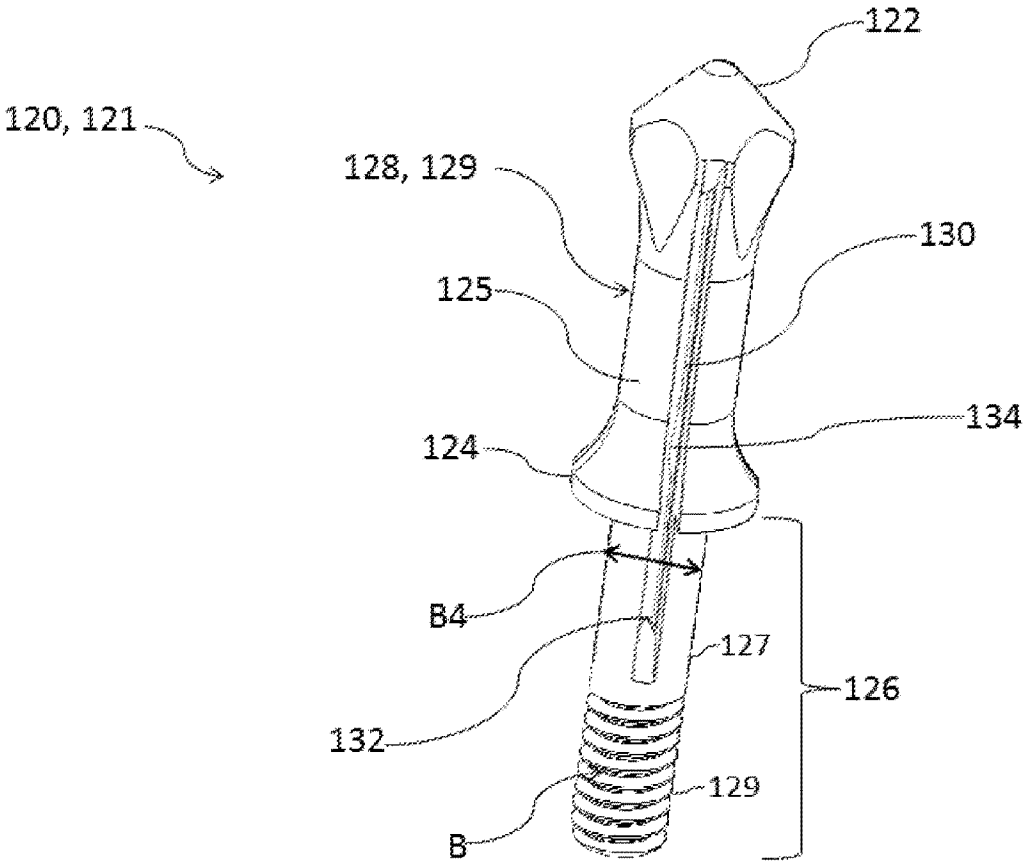
FIG. 8 is a top view of an embodiment of a standard blade holder.

In an embodiment illustrated in FIG. 7, the ferrule or blade holder 220 of the micro arrowhead assembly 202 (FIG. 2) is a micro blade holder 221. Micro blade holder 221 has a micro head 231. As shown, the micro head 231 generally has a larger diameter than standard head 129 (FIG. 8). The particular shape and girth of the micro head 231 can be a weight factor in achieving the arrowhead assembly threshold weight of X grains for the micro arrowhead assembly 202.

In an embodiment illustrated in FIG. 8, the ferrule or blade holder 120 of the standard arrowhead assembly 102 (FIG. 1) is a standard blade holder 121. Standard blade holder 121 has a standard head 129. As shown, standard head 129 (FIG. 8) generally has a smaller diameter than micro head 231 (FIG. 7). Furthermore, the surface of standard head 129 has more of a concave shape and greater arc-shape than micro head 231. The particular shape of micro head 231 can be a weight factor for achieving the arrowhead assembly threshold weight of X grains for the micro arrowhead assembly 202. Likewise, the particular shape of the standard head 128 (FIG. 7) can be a factor in achieving the arrowhead assembly threshold weight of X grains for the standard arrowhead assembly 102. For example, the increased concavity of standard head 128 reduces the weight of standard blade holder 121. This weight reduction, when taken into account with the weight added by arrowhead adapter 150, is a factor in achieving the optimal arrowhead assembly threshold weight of X or Y grains for the standard arrowhead assembly 102, as described above.

In an embodiment shown in FIG. 8, the standard blade holder 121, defines a set of longitudinal slots including slot 130 and an intersecting slot (not shown). Likewise, in an embodiment shown in FIG. 7, the micro blade holder 221 defines a set of longitudinal slots including slot 230 and an intersecting slot (not shown). In each such set of slots, each slot extends in a plane, and the two planes intersect at or about a ninety degree angle with the vertex positioned at the radial center 132, 232 of the blade holder 121, 221. The longitudinal slots 130, 230 extend axially along the head 129, 231 and into the primary neck portion or shank portion 126, 226, and radially from the center 132, 232 of the blade holder 121, 221 through the outer surface 125, 225 of the blade holder 121, 221 such that each longitudinal slot 130, 230 creates a passage 134, 234 that traverses the blade holder 121, 221. The passages 134, 234 intersect each other at the center 132, 232 of the blade holder 121, 221.

As shown in FIGS. 7-8, the blade holders 121, 221 are substantially tubular, however it should be appreciated that the geometry of the blade holders 121, 221, or any portion of the blade holders 121, 221 may not be tubular and may vary from that shown. The blade holders 121, 221 may be made from stainless steel, carbon, titanium or any other durable, rust proof or rust resistant material capable of maintaining a sharp edge and resisting deformation or fracturing upon impact with a target, or any combination of such materials.

Figure 9:
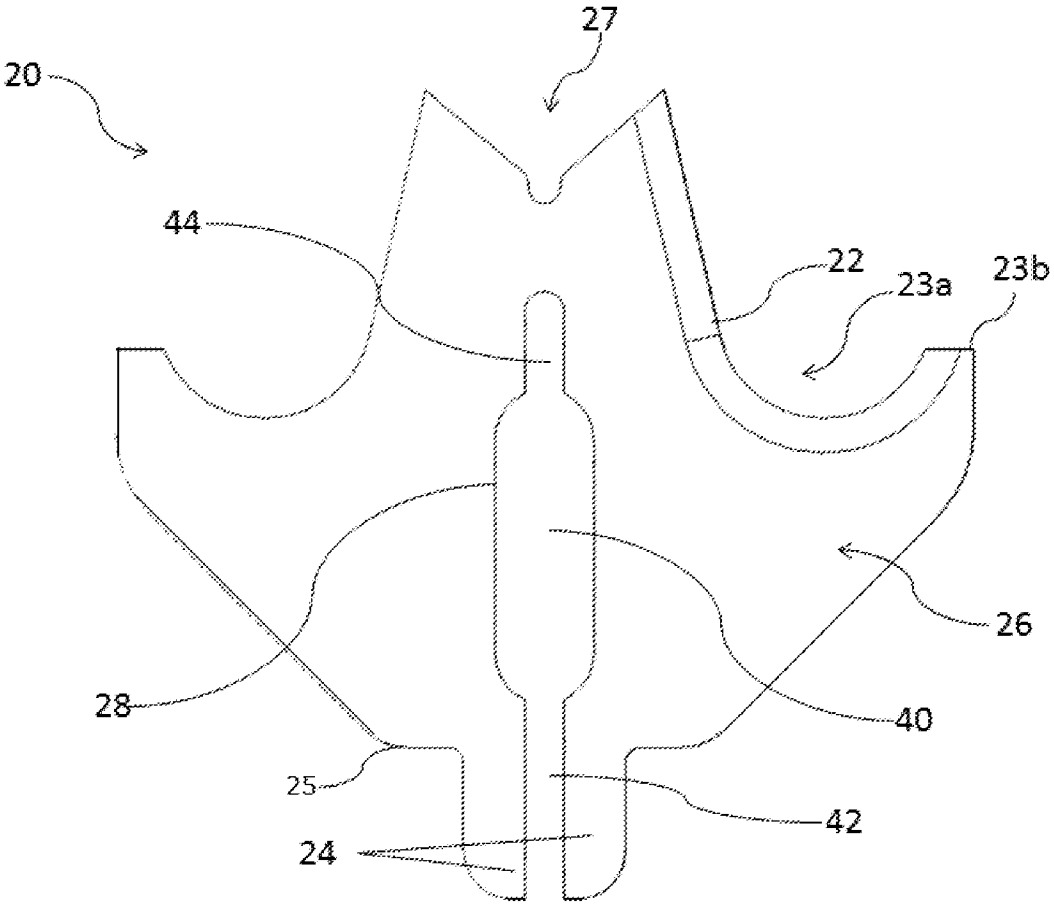
FIG. 9 is a side view of an embodiment of a first blade.
Figure 10:
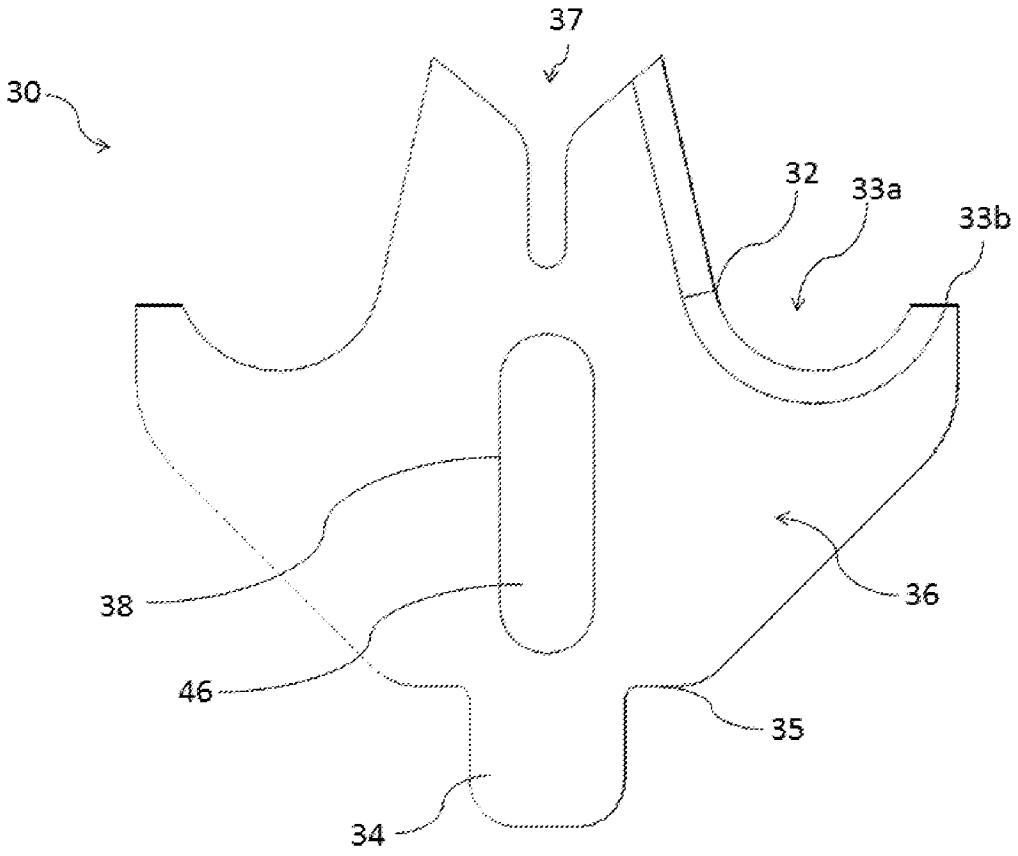
FIG. 10 is a side view of an embodiment of a second blade configured to fit together with the first blade.

Referring to FIGS. 9-10, the micro common elements 206 (FIGS. 1-2) include a plurality of broadheads or blades 20, 30, as described above. The first blade 20 and the second blade 30 each has at least two separate blade edges or cutting edges 22, 32 disposed on opposing sides of the blade 20, 30. As shown in FIGS. 9-10, the cutting edges 22, 32 have a portion that is substantially linear and a portion that is curved, however other embodiments may have other configurations of curved and linear spans of the cutting edges 22, 32. In the embodiment shown in FIGS. 9-10, each blade 20, 30 is of the single bevel edge configuration in which the first blade 20 and the second blade 30 are planar, and each cutting edge 22, 32 has a hook-shaped portion 23*a*, 33*a* with pointed ends 23*b*, 33*b*; however it should be appreciated that other embodiments of the first blade 20 and the second blade 30 may be used that have blade edge profiles that are not hook shaped. Depending upon the embodiment, each blade 20, 30 can have a double bevel edge configuration in which each side of the blade has a beveled cutting edge. The first blade 20 (FIG. 9) has a slotted tab 24, and the second blade 30 (FIG. 10) has a tab 34 that fits into slotted tab 24. Each blade 20, 30 has a blade shoulder or base 25, 35. As described below, the blade shoulder 25, 35 is configured to engage or otherwise cooperate with shaft 104 or 204 as applicable.

Each blade 20, 30 has a tip engager 27, 37 located at the end of such blade. The tip engager 27, 37 is configured to make contact with, and engage, the tip 122, 222 (FIGS. 7-8) of the blade holder 121, 221. In addition, each of the blades 20, 30 has an elongated or longitudinal aperture 40, 46 extending from the front surface 26, 36 through the rear surface (not shown) of the blade 20, 30. Each longitudinal aperture 40, 46 is defined by an interior surface 28, 38. Each of the blades 20, 30 may be made from stainless steel, carbon, titanium or any other durable, rust proof or rust resistant material capable of maintaining a razor sharp edge and resisting deformation or fracturing upon impact with a target, or any combination of such materials.

Referring to FIG. 9, the aperture 40 of the first blade 20 has additional bottom and top slots (42 and 44, respectively). The bottom slot 42 projects towards the slotted tab 24 and may bisect the slotted tab 24 into two portions. The top slot 44 projects towards the tip engager 27. In the embodiment shown, the top and bottom slots 42, 44 have a maximum diameter that is smaller than the aperture 40.

Referring to FIGS. 5-10, the first blade 20 and the second blade 30 are retained within the blade holder 121, 221 such that the tabs 24, 34 are contained within the longitudinal slot 130, 230 of the neck 126, 226. The blade edges 22, 32 protrude radially with respect to the outer surface 125, 225 of the blade holder 120,220. As shown, the longitudinal slots 130, 230 are slightly wider than the thickness of each blade 20, 30 to enable each blade to pass through the blade holder 120, 220 while still providing lateral stability. In addition, the longitudinal slots 130, 230 limit the amount of axial movement that that blades 20, 30 can undergo relative to the blade holder 121, 221.

It should be understood that blade set 20, 30 can be installed onto blade holder 121 (FIG. 7), and blade set 20, 30 can be installed onto blade holder 221 (FIG. 8). In each case, during assembly, the first blade 20 is disposed within a longitudinal slot 130, 230 and passed through the passage 134, 234 so that the elongates aperture 40, 46 and the top and bottom slots 42, 44 are located at the center 132, 232 of the blade holder 121, 221. The second blade 30 is passed through the other longitudinal slot (not shown) at an angle so that the tip engager 27, 37 moves into the passage 134, 234 first. The second blade 30 is then rotated so that the tab 34 is retained in the primary neck portion 127, 227 and resting between the bisected tab 24 of the first blade 20. In the assembled state, the first blade 20 and the second blade 30 are perpendicular, or substantially perpendicular, to each other.

It should be appreciated that the blades 20, 30 are only an example of the type of blades that can be used with the blade holders 120, 220. Depending upon the embodiment, blades and pointed heads of different shapes, sizes and structures can be coupled to either such blade holder, including, but not limited to: (a) broadhead arrowheads incorporating two, three or more razor-sharp blades; (b) bullet point arrowheads; (c) blunt point arrowheads; (d) field point arrowheads; and (e) fish point arrowheads.

Figure 11:
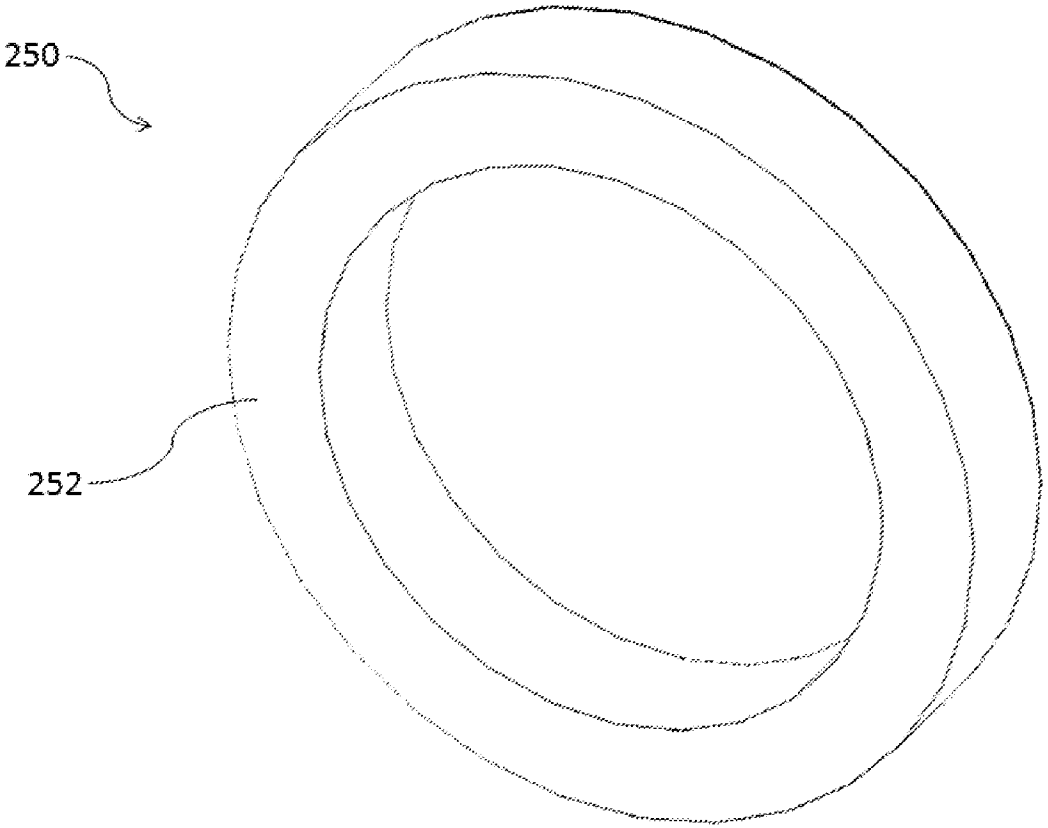
FIG. 11 is an isometric view of an embodiment of an intermediary member.

Referring to FIGS. 2, 6, and 11, the micro arrow 200 includes, in an embodiment, an intermediary member 250 that is sandwiched between the blades 20, 30 and the terminating surface 211 (FIG. 2) of the micro arrow shaft 204. In addition to the advantages described below, the intermediary member 250 is a weight factor for achieving the threshold weight of X grains of the micro arrowhead assembly 202. In the embodiment shown in FIGS. 2 and 11, the intermediary member 250 has a ring, tubular or washer shape. In an embodiment, the intermediary member 250 slides onto the micro primary neck portion 227 until abutting the blade shoulders 25, 35. In an embodiment, the micro primary neck portion 227 has a protrusion or catch (not shown) that cooperates with the intermediary member 250 so as to establish a press-fit or snap-fit connection between the micro primary neck portion 227 and the intermediary member 250. After connecting the intermediary member 250 to the primary neck micro portion 227, the intermediary member 250 retains the axial position of the blades 20, 30 on the blade holder 220 (FIG. 2) even before the blade holder 220 is screwed into the micro arrow shaft 204.

In addition, during shooting, the intermediary member 250 receives the impact from the blades 20, 30 and distributes the impact force across the intermediary surface 252 (FIG. 11) of the intermediary member 250 that faces the terminating surface 211 (FIG. 2) of the micro arrow shaft 204. Referring to FIG. 11, the intermediary surface 252 has a flat shape that is the same as, or substantially the same as, the shape of the terminating surface 211. The distribution of the impact force across the intermediary surface 252 reduces damage to the terminating surface 211 during shooting.

Referring back to FIGS. 3-5, the standard arrow 100 includes, in an embodiment, the arrowhead adapter 150, as described above. The arrowhead adapter 150 serves a plurality of roles for the standard arrow 100. The arrowhead adapter 150 enables the micro common elements 206 to be used with the standard arrow shaft 104. For example, the micro neck diameter A4, configured for micro arrow shaft 204, is relatively small in diameter. As such, micro neck diameter A4 is structurally suitable for micro arrow shaft 204 but would not be structurally suitable for standard arrow shaft 104 without the use of arrowhead adapter 150.

Also, the relatively small diameter of A4 results in a relatively low arrowhead assembly weight that meets the weight threshold of X grains for micro arrowhead assembly 202 (FIG. 1). However, because of differences between the micro head assembly 202 (FIG. 6) and standard arrowhead assembly 102 (FIG. 5), such low weight would cause the weight of standard arrowhead assembly 102 to fall below the weight threshold of X or Y grains. Therefore, the arrowhead adapter 150 compensates for such weight insufficiency by adding weight to achieve the optimal or designated weight threshold of X or Y grains for the standard arrowhead assembly 102.

In an embodiment illustrated in FIGS. 3-4 and 12-13, the arrowhead adapter 150 includes arrowhead adapter 150*a*. Arrowhead adapter 150*a* is configured to be sandwiched between the blades 20, 30 and the terminating surface 111 of the standard arrow shaft 104. As described below, the arrowhead adapter 150*a* enables a common blade set 20, 30 and the micro neck diameter A4 (FIGS. 1 and 3) to be used with arrow shafts 104, 204 (FIGS. 1-2) of different diameters while achieving the applicable arrowhead assembly threshold weights associated with the different types of arrow shafts.

Figure 12:
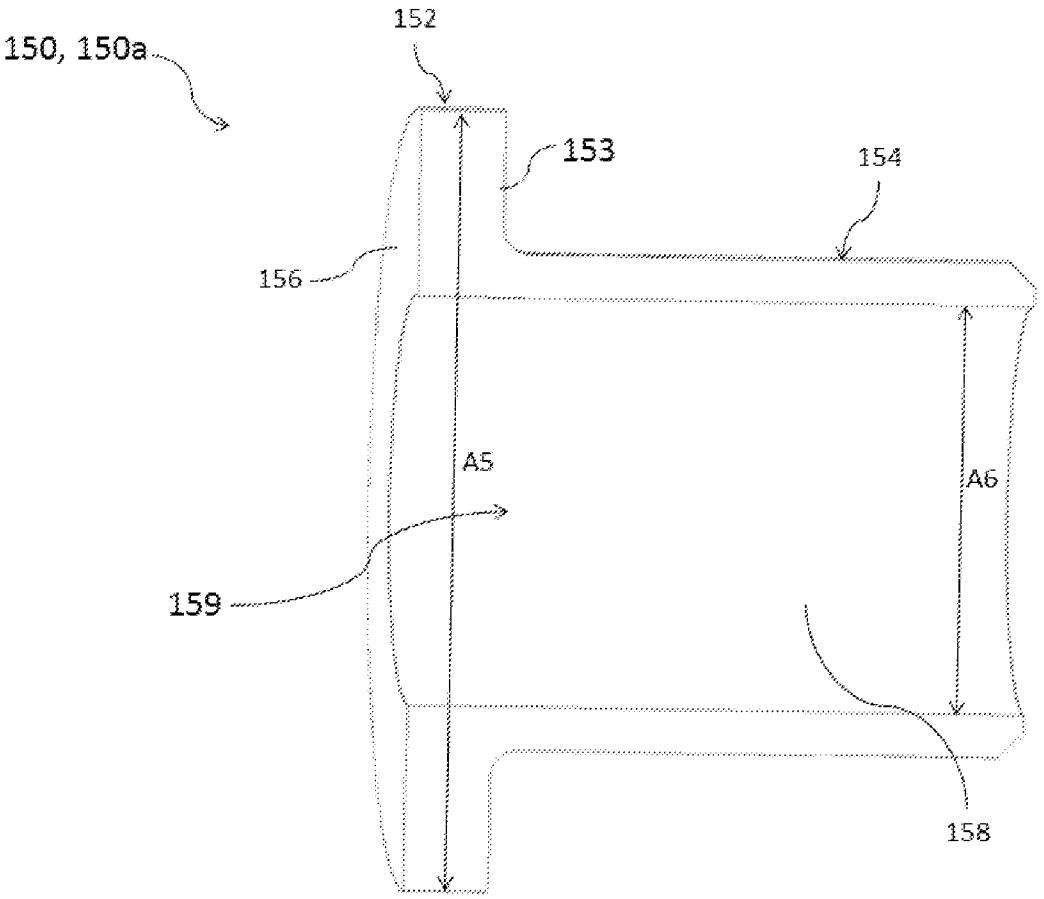
FIG. 12 is a cross-sectional view of an embodiment of an arrowhead adapter.
Figure 13:
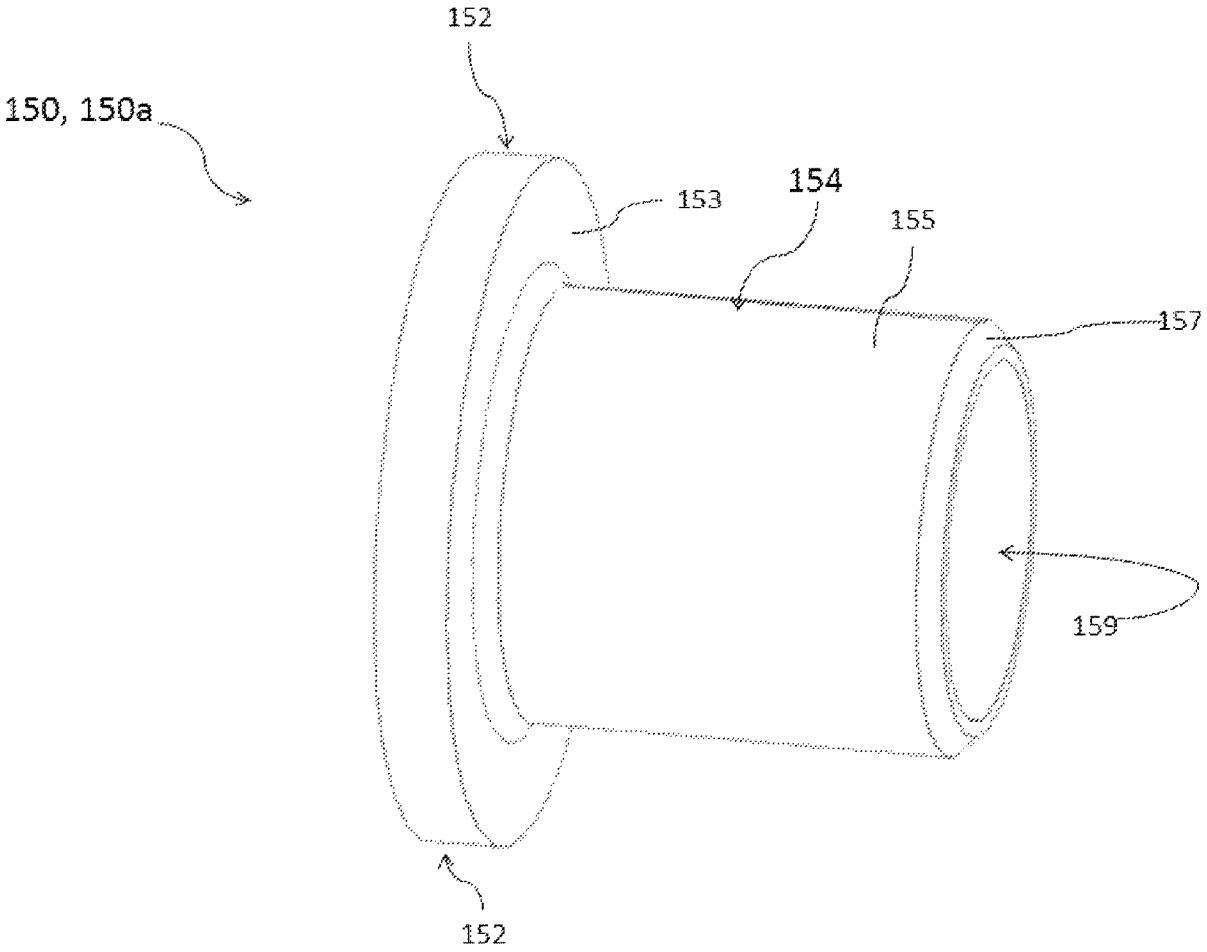
FIG. 13 is an isometric view of the arrowhead adapter of FIG. 12.

Referring to FIGS. 12-13, the arrowhead adapter 150*a* includes a flange portion or interface 152 that is configured to be sandwiched between, and serve as a buffer between, the blade shoulders 25, 35 (FIGS. 9-13) and the terminating surface 111 (FIGS. 1 and 3) of the standard arrow shaft 104. In an embodiment, the interface 152 has: (a) a blade engager 156 configured to face and abut the blade shoulders 25, 35; (b) an arrow shaft engager 153 configured to face and abut the terminating surface 111 of the standard arrow shaft 104; and (c) a tubular adapter body 154 configured to extend toward and insert into the cavity 114 (FIG. 1) of the standard arrow shaft 104. In the embodiment shown, the blade engager 156, arrow shaft engager 153 and adapter body 154 are a single piece of material; however, in other embodiments the blade engager 156, arrow shaft engager 153 and adapter body 154 can be separate components. Though the outer surface 155 (FIG. 13) of adapter body 154 is shown as smooth, it should be appreciated that the surface 155 of adapter body 154 can be grooved, threaded, notched, knurled, or have other surface features that foster a secure fit with the impact end 108 of standard arrow shaft 104.

As illustrated in FIG. 12, the adapter body 154 had an inner surface 158 which defines a passageway or central bore 159 that traverses and extends through both the blade engager 156 and the arrow shaft engager 153. As shown, the outer diameter A5 of the interface 152 is greater than the diameter A6 of the central bore 159. The arrowhead adapter 150*a* may be made from stainless steel, carbon, titanium or any other durable, rust proof material capable of resisting deformation or fracturing upon impact with a target, or any combination of such materials.

Referring to FIGS. 1, 3-5, and 12-13, during assembly of the standard arrowhead assembly 102, the arrowhead adapter 150*a* is slid over the neck 226 until the threaded neck portion 229 protrudes. At that point, the micro primary neck portion 227 (FIG. 3) is located within the central bore 159 (FIG. 13), and the forward facing surface or blade engager 156 (FIG. 12) engages the shoulder 224 (FIG. 3) and the blade shoulders 25, 35 (FIG. 9-10) of the blades 20, 30. The blade engager 156 of arrowhead adapter 150*a* acts to restrain axial movement of the blades 20, 30 that may occur in response to the tail momentum experienced when the standard arrow 100 is initially shot from a bow (not shown), or the impact force of the tip 222 (FIG. 5) striking the target medium (not shown). In an embodiment, the micro primary neck portion 227 has a protrusion or catch (not shown) that cooperates with the arrowhead adapter 150*a* so as to establish a press-fit, snap-fit or slip-fit connection between the micro primary neck portion 227 and the arrowhead adapter 150*a*.

Figure 3:
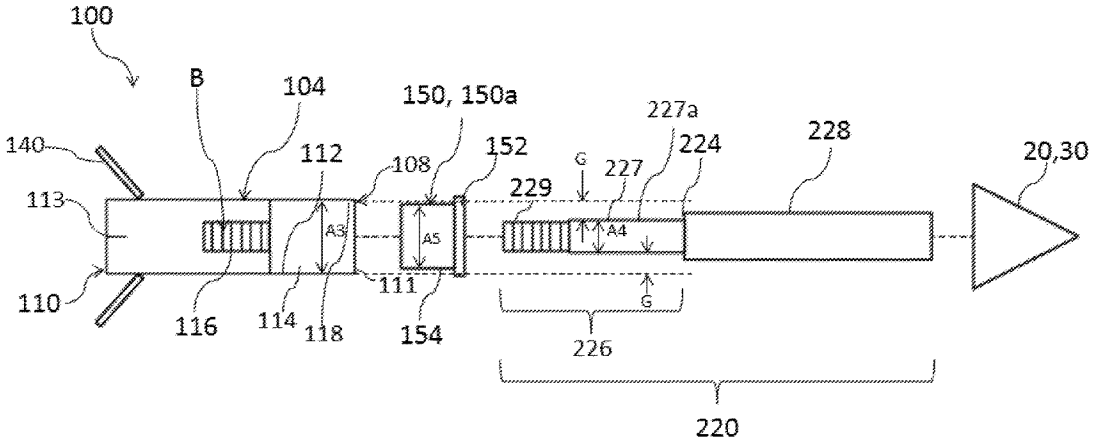
FIG. 3 is an exploded view of the arrowhead assembly of FIG. 1.
Figure 4:
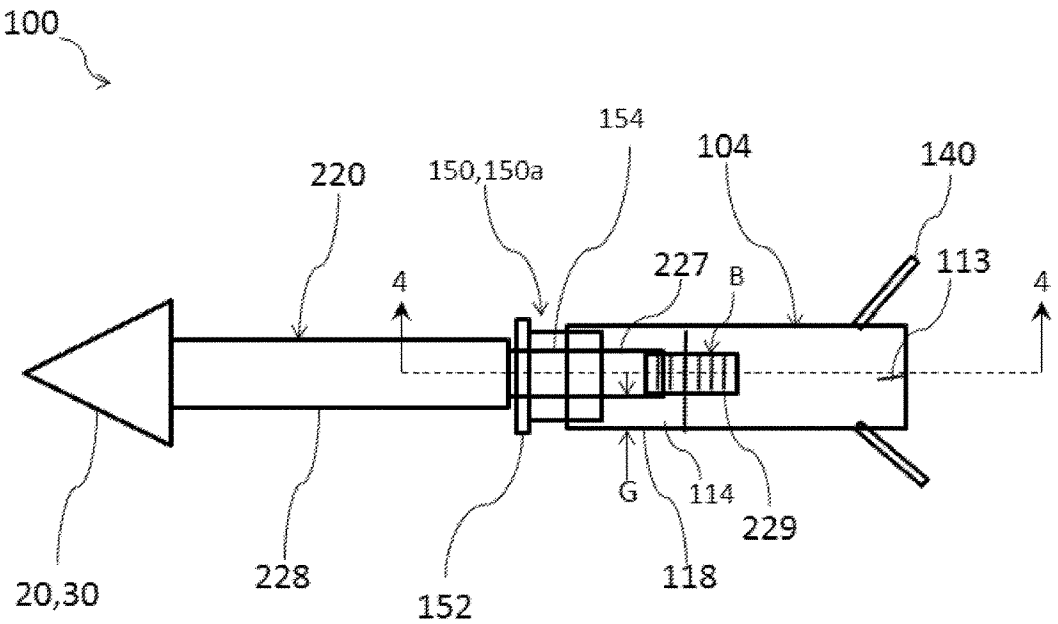
FIG. 4 is a schematic diagram illustrating the arrowhead assembly of FIG. 1, illustrating the arrowhead assembly inserted into a standard arrow shaft.

When fully assembled as shown in FIG. 4, the threaded neck portion 229 extends beyond, and is not housed within, the central bore 159 of arrowhead adapter 150*a*. As such, the threads of the threaded neck portion 229 are uncovered, exposed and ready for engagement with the threaded shaft section 116 (FIG. 3) of the standard arrow shaft 104.

Figure 5:
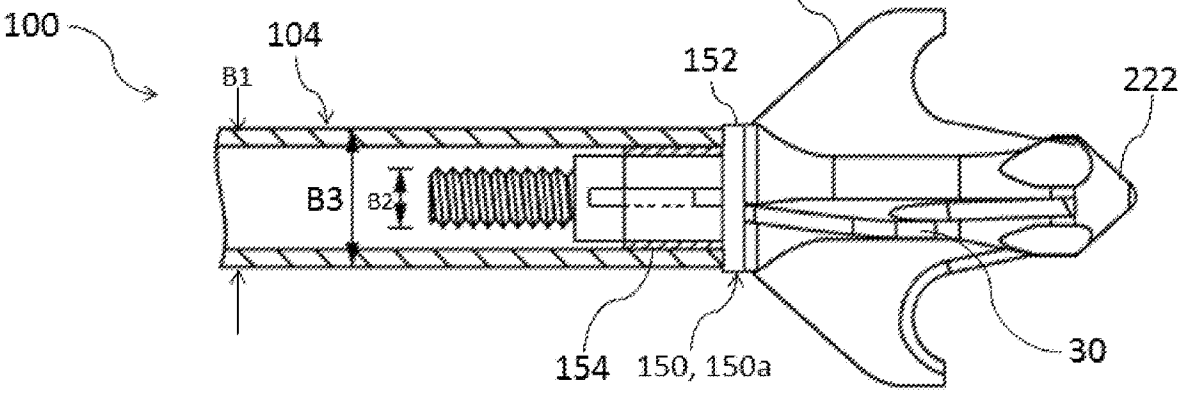
FIG. 5 is a partial cross-sectional view of the arrowhead assembly and standard arrow shaft of FIG. 4, taken substantially along line 4-4 of FIG. 4.

The standard arrowhead assembly 102 is then screwed onto the impact end 108 of the standard arrow shaft 104. After this, the adapter body 154 (FIG. 13) is housed within the non-threaded shaft section 112 of the standard arrow shaft 104. At that location, the adapter body 154 serves as an arrow shaft engager disposed between the exterior surface 227*a* (FIG. 3) of the primary neck portion 227 and the interior surface 118 (FIG. 3) of the standard arrow shaft 104, as illustrated in FIGS. 3-5. The interface 152 is located outside of the standard arrow shaft 104 and acts as a buffer between the blades 20, 30 and the standard arrow shaft 104. The rearward facing surface or arrow shaft engager 153 (FIG. 13) of the interface 152 contacts and engages the terminating surface 111 of the impact end 108 of the standard arrow shaft 104. During shooting, the interface 152 receives the impact from the blades 20, 30 and distributes the impact force across the arrow shaft engager 153 of the interface 152. The arrow shaft engager 153 has a flat shape that is the same as, or substantially the same as, the shape of the terminating surface 111 of the standard arrow shaft 104. The distribution of the impact force across the arrow shaft engager 153 reduces damage to the terminating surface 111 during shooting.

As indicated above, the primary neck portion 227 has a micro size diameter A4 even though the primary neck portion 227 is used with the standard arrow shaft 104. Because of the relatively large diameter of the standard arrow shaft 104, there is a gap G (FIGS. 3 and 4) between the exterior surface 227*a* of the primary neck portion 227 and the interior surface 118 of the non-threaded shaft section 112. This gap G can cause instability as well as torsion or bending forces between the standard arrowhead assembly 102 and the standard arrow shaft 104. These forces can cause fractures in the standard arrow shaft 104. Also, the gap G can enable a wobbling movement between the standard arrowhead assembly 102 and the standard arrow shaft 104. This wobbling movement can cause the standard arrow 100 to have sub-optimal or poor flight performance.

To address these disadvantages, the adapter body 154 has a thickness that is configured to be inserted into the gap G as illustrated in FIGS. 3-4 and 12. There, the adapter body 154 fills or occupies part or all of the gap G while engaging both the primary neck portion 227 and the interior surface 118 of the non-threaded shaft section 112. In this position, the adapter body 154 provides lateral stability by occupying this gap G. In an embodiment, the adapter body 154, acting as an arrow shaft engager, causes a tight fit between the primary neck portion 227 and the interior surface 118 of the non-threaded shaft section 112. The tight fit eliminates or reduces the wobbling and instability issues described above. In an embodiment, the tight fit and lateral support provided by the arrowhead adapter 150*a* satisfies the tolerance standards of the Archery Manufacturers and Merchants Organization (AMO) for diameter of conventional threads 8-32, including, but not limited to, 0.2025 inches through 0.2045 inches. Furthermore, such tight fit and lateral support provides the standard arrow 100 with the same, or substantially the same, structural integrity as that of a standard arrow that has a standard-sized, primary neck portion (not shown) of a standard ferrule or blade holder.

In addition, as indicated above, the use of the primary neck portion 227 having micro size diameter A4 results in an overall arrowhead assembly weight that would fall below the standard threshold weight, that is, the weight associated with a standard arrow having a standard arrow shaft diameter larger than micro size. Accordingly, the arrowhead adapter 150*a* is configured and calibrated to add the weight necessary to reach the standard threshold weight for optimum performance of the standard arrow 100. In an example, the designated threshold weight of standard arrowhead assembly 102 is 100 grains. However, due to the micro diameter A4, the standard arrowhead assembly 102 would be less than 100 grains without the added weight of the arrowhead adapter 150*a*. The arrowhead adapter 150*a* provides the extra weight necessary to achieve the designated threshold weight. In an embodiment, the shape and placement of the arrowhead adapter 150*a* allows for its weight to be added closer to the center of rotation 80 (FIGS. 1-2) thereby improving the flight performance, accuracy and penetration of the standard arrow 100.

The arrowhead adapter 150, 150*a* facilitates the use of a common arrowhead assembly elements amongst different types of blade holders. For example, the arrowhead adapter 150, 150*a* enables the neck or other structure of a micro blade holder (configured for a micro arrow shaft) to be used for a standard blade holder. In serving this role, the arrowhead adapter 150, 150*a* provides the structural integrity for use with a standard arrow shaft, and the arrowhead adapter

150, 150*a* also provides the weight supplement for achieving the weight threshold for the standard arrowhead assembly.

Additional embodiments include any one of the embodiments described above and described in any and all exhibits and other materials submitted herewith, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. An arrowhead adapter comprising:

an interface comprising:

a blade engager configured to engage at least one blade held by a blade holder, the blade holder comprising a neck, the neck comprising:

a primary neck portion, the primary neck portion comprising a neck diameter; and a threaded neck portion comprising a plurality of neck threads;

a shaft member engager configured to engage a shaft end of an arrow shaft member, the arrow shaft member comprising:

a non-threaded shaft portion comprising an inner shaft diameter; and a threaded shaft portion comprising a plurality of shaft threads; and a body extending from the shaft member engager, the body comprising a tubular wall configured to receive the primary neck portion of the blade engager, wherein the interface and the body define a bore, and wherein, when the neck is inserted into bore and the threaded neck portion is screwed into the shaft member:

the neck diameter is such that there is a gap between the primary neck portion of the blade engager and the non-threaded shaft portion;

the tubular wall is configured to fit within the gap and apply a stabilizing force to the blade holder;

the at least one blade and the blade holder have an initial weight that is less than a weight threshold; and the interface and the body have a supplemental weight; and a sum of the initial weight and the supplemental weight is at least as great as the weight threshold.

2. The arrowhead adapter of claim 1, wherein the interface and the body are portions of a one-piece member.

3. The arrowhead adapter of claim 1, wherein the interface and the body provide a supplemental weight for achieving an optimal weight threshold for a standard arrowhead assembly.

4. The arrowhead adapter of claim 1, wherein the primary neck portion cooperates with a portion of the arrowhead adapter so as to establish a press-fit, snap-fit or slip-fit connection between the primary neck portion and the portion of the arrowhead adapter.

5. The arrowhead adapter of claim 1, wherein the interface has a diameter that is greater than a diameter of the body.

6. The arrowhead adapter of claim 1, wherein the bore has an inner surface that is substantially tubular.

7. An arrowhead adapter comprising:

a flange portion having a forward end and a rearward end, wherein the forward end is configured to engage a portion of a blade and a blade holder;

a body portion projecting from the rearward end of the flange portion, the body portion having an outer surface configured to fit within a gap formed between an inner surface of an arrow shaft and the blade holder, wherein, when the blade holder is coupled to the arrow shaft, the flange portion is configured to apply a stabilizing force to the blade holder when the arrowhead adapter and the blade holder are arranged in an assembled state; and a central bore extending through the flange portion and the body portion, the central bore being defined by a tubular wall and configured to receive a portion of the blade holder, wherein, in the assembled state, the forward end of the flange portion is at least partially engaged with a base portion of the blade.

8. The arrowhead adapter of claim 7, wherein the flange portion and the body portion are portions of a single-piece structure.

9. The arrowhead adapter of claim 7, wherein the flange portion has a diameter that is substantially equal to an outer diameter of the arrow shaft.

10. The arrowhead adapter of claim 7, wherein a diameter of the central bore is less than the diameter of the flange portion.

11. The arrowhead adapter of claim 7, wherein the flange portion and the body portion provide a supplemental weight for achieving a weight threshold for a standard arrowhead assembly.

12. The arrowhead adapter of claim 11, wherein the flange portion and the body portion are configured to locate the supplemental weight closer to a center of rotation than any blade tips of the standard arrowhead assembly to improve flight performance of a standard arrow.

13. The arrowhead adapter of claim 7, wherein the body portion is engaged with the inner surface of the arrow shaft and an outer surface of the blade holder when in the assembled state.

14. The arrowhead adapter of claim 7, wherein the blade holder is configured to removably receive the blade, wherein, in the assembled state, the forward end is engaged with: (a) the blade holder; and (b) the blade, wherein the engagement generates a support force to secure the blade on the blade holder when the blade is subject to another force exerted by a target.

15. An arrowhead assembly comprising:

an arrowhead adapter comprising:

a blade engager configured to contact at least one blade;

a shaft member engager configured to engage an arrow shaft member; and a body member defining a channel;

a blade holder configured to retain the at least one blade, the blade holder comprising a neck, the neck comprising:

a primary neck portion, the primary neck portion comprising an exterior surface, the exterior surface comprising a neck diameter, wherein the primary neck portion is configured to be inserted into the channel of the body member; and a threaded neck portion comprising a plurality of exterior neck threads configured to be inserted into a cavity defined by an inner surface of the arrow shaft member, wherein the cavity comprises is larger diameter than the neck diameter, wherein, when the threaded neck portion is inserted through the channel, positioned in the cavity and threadably engaged with the arrow shaft member, the body member of the arrowhead adapter is configured to fit between an exterior surface of the primary neck portion and the inner surface of the arrow shaft member.

16. The arrowhead assembly of claim 15, wherein the at least one blade and the blade holder have an initial weight that is less than a weight threshold.

17. The arrowhead assembly of claim 16, wherein the blade engager and the body member have a supplemental weight that is less than the weight threshold.

18. The arrowhead assembly of claim 17, wherein a sum of the initial weight and the supplemental weight is at least as great as the weight threshold.

19. The arrowhead assembly of claim 18, wherein the supplemental weight is located closer to a center of rotation than any blade tips of the at least one blade thereby improving flight performance of a standard arrow.

20. The arrowhead assembly of claim 15, wherein the body member of the arrowhead adapter is configured to at least partially fill a gap between the exterior surface of the primary neck portion and the inner surface of the arrow shaft member.

21. The arrowhead assembly of claim 15, wherein the portion of the neck cooperates with a portion of the arrowhead adapter to establish a press-fit, snap-fit or slip-fit connection between the portion of the neck and the portion of the arrowhead adapter.

22. The arrowhead assembly of claim 15, wherein:

the blade holder comprises a first exterior diameter associated with a first size standard;

the first size standard is associated with a first arrow shaft diameter;

the arrow shaft member comprises a second arrow shaft diameter that is greater than the first arrow shaft diameter;

the second arrow shaft diameter is associated with a second size standard which is greater than the first size standard; and the arrowhead adapter is configured to enable the blade holder associated with the first size standard to fit with the arrow shaft member associated with the second size standard.

* * * * *